US008847481B2

(12) United States Patent
Park et al.

(10) Patent No.: US 8,847,481 B2
(45) Date of Patent: Sep. 30, 2014

(54) LIGHTING DEVICE COMPRISING PHOTOLUMINESCENT PLATE

(75) Inventors: Jong Chan Park, Seoul (KR); Young Jin Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 78 days.

(21) Appl. No.: 13/290,477

(22) Filed: Nov. 7, 2011

(65) Prior Publication Data

US 2012/0112630 A1 May 10, 2012

(30) Foreign Application Priority Data

| | | |
|---|---|---|
| Nov. 8, 2010 | (KR) | 10-2010-0110560 |
| Nov. 22, 2010 | (KR) | 10-2010-0116127 |
| Nov. 23, 2010 | (KR) | 10-2010-0116792 |
| Nov. 23, 2010 | (KR) | 10-2010-0116793 |
| Nov. 23, 2010 | (KR) | 10-2010-0116794 |
| Nov. 23, 2010 | (KR) | 10-2010-0116795 |
| Nov. 23, 2010 | (KR) | 10-2010-0116796 |

(51) Int. Cl.

| | |
|---|---|
| ***H01J 1/62*** | (2006.01) |
| ***H01J 63/04*** | (2006.01) |
| ***F21V 9/16*** | (2006.01) |
| ***F21K 99/00*** | (2010.01) |
| ***F21V 3/00*** | (2006.01) |
| *F21V 3/04* | (2006.01) |
| *F21Y 101/02* | (2006.01) |
| *F21V 29/00* | (2006.01) |
| *F21V 15/01* | (2006.01) |

(52) U.S. Cl.

CPC ..... *F21K 9/56* (2013.01); *F21V 3/0463* (2013.01); *F21Y 2101/02* (2013.01); *F21V 9/16* (2013.01); *F21V 3/0481* (2013.01); *F21V 29/004* (2013.01); *F21V 15/011* (2013.01); *F21V 29/2206* (2013.01); *F21V 3/00* (2013.01); *F21K 9/135* (2013.01); *F21K 9/00* (2013.01)

USPC ..... 313/506; 313/498; 313/501; 313/502; 362/260; 362/268; 362/293; 362/307; 362/308; 362/311.02

(58) Field of Classification Search

USPC ..... 313/498, 501, 502, 506; 362/260, 268, 362/293, 307, 308, 311.02

See application file for complete search history.

(56) References Cited

U.S. PATENT DOCUMENTS

| | | | | |
|---|---|---|---|---|
| 7,285,791 | B2 * | 10/2007 | Beeson et al. | 250/487.1 |
| 7,795,600 | B2 * | 9/2010 | Beeson et al. | 250/483.1 |
| 7,819,539 | B2 * | 10/2010 | Kim et al. | 362/84 |
| 7,999,283 | B2 * | 8/2011 | Chakraborty et al. | 257/100 |
| 8,063,557 | B2 * | 11/2011 | Hsieh et al. | 313/506 |

(Continued)

FOREIGN PATENT DOCUMENTS

| | | | |
|---|---|---|---|
| KR | 2006-0071033 | A | 6/2006 |
| KR | 2010-0077196 | A | 7/2010 |

(Continued)

*Primary Examiner* — Thomas A Hollweg

(74) *Attorney, Agent, or Firm* — Birch, Stewart, Kolasch & Birch, LLP

(57) ABSTRACT

A lighting device including a photoluminescent plate may be provided that includes a light source and a photoluminescent plate disposed over the light source. The photoluminescent plate includes a base layer and a first phosphor layer. The base layer transmits light and has a first roughness on one surface thereof. The first phosphor layer is disposed on the one surface of the base layer and includes a first phosphor.

19 Claims, 17 Drawing Sheets

(56) References Cited

U.S. PATENT DOCUMENTS

| | | | | |
|---|---|---|---|---|
| 8,169,141 | B2 * | 5/2012 | Xu et al. | 313/512 |
| 2002/0180351 | A1 * | 12/2002 | McNulty et al. | 313/512 |
| 2004/0012958 | A1 * | 1/2004 | Hashimoto et al. | 362/241 |
| 2004/0217364 | A1 * | 11/2004 | Tarsa et al. | 257/89 |
| 2005/0224821 | A1 * | 10/2005 | Sakano et al. | 257/79 |
| 2006/0163601 | A1 | 7/2006 | Harle et al. | |
| 2007/0267976 | A1 | 11/2007 | Bohler et al. | |
| 2008/0128730 | A1 * | 6/2008 | Fellows et al. | 257/98 |
| 2009/0057698 | A1 * | 3/2009 | Okamura et al. | 257/98 |
| 2010/0066236 | A1 * | 3/2010 | Xu et al. | 313/498 |
| 2010/0103648 | A1 * | 4/2010 | Kim et al. | 362/97.1 |
| 2010/0123386 | A1 * | 5/2010 | Chen | 313/502 |
| 2010/0142182 | A1 * | 6/2010 | Van Woudenberg et al. | 362/84 |
| 2010/0213881 | A1 | 8/2010 | Imai | |
| 2010/0246160 | A1 * | 9/2010 | Ito et al. | 362/84 |
| 2010/0301367 | A1 * | 12/2010 | Nakamura et al. | 257/98 |
| 2010/0328926 | A1 * | 12/2010 | Hoelen et al. | 362/84 |
| 2011/0025191 | A1 * | 2/2011 | Xu et al. | 313/501 |
| 2011/0182056 | A1 * | 7/2011 | Trottier et al. | 362/84 |
| 2011/0215700 | A1 * | 9/2011 | Tong et al. | 313/46 |
| 2011/0215701 | A1 * | 9/2011 | Tong et al. | 313/46 |

FOREIGN PATENT DOCUMENTS

| | | | |
|---|---|---|---|
| WO | WO 2009/107052 | A1 | 9/2009 |
| WO | WO 2009/125314 | A2 | 10/2009 |
| WO | WO 2010/035176 | A1 | 4/2010 |

* cited by examiner

LIGHTING DEVICE COMPRISING PHOTOLUMINESCENT PLATE

CROSS-REFERENCE TO RELATED APPLICATION

This application claims priority under 35 U.S.C. §119 from Korean Application No. 10-2010-0110560, filed Nov. 8, 2010, No. 10-2010-0116793, filed Nov. 23, 2010, No. 10-2010-0116792, filed Nov. 23, 2010, No. 10-2010-0116127, filed Nov. 22, 2010, No. 10-2010-0116794, filed Nov. 23, 2010, No. 10-2010-0116795, filed Nov. 23, 2010 and No. 10-2010-0116796, filed Nov. 23, 2010, the subject matters of which are incorporated herein by reference.

BACKGROUND

1. Field

Embodiments may relate to a lighting device including a photoluminescent plate.

2. Background

A light emitting diode (LED) is a semiconductor element for converting electric energy into light. As compared with existing light sources such as a fluorescent lamp and an incandescent electric lamp and so on, the LED has advantages of low power consumption, a semi-permanent span of life, a rapid response speed, safety and an environment-friendliness. For this reason, many researches are devoted to substitution of the existing light sources with the LED. The LED is now increasingly used as a light source for a light unit, for example, various lamps used interiorly and exteriorly, a liquid crystal display device, an electric sign and a street lamp and the like.

SUMMARY

One embodiment is a lighting device. The lighting device includes a light source and a photoluminescent plate disposed over the light source. The photoluminescent plate may include a base layer and a first phosphor layer. The base layer transmits light and has a first roughness on one surface thereof. The first phosphor layer is disposed on the one surface of the base layer and includes a first phosphor.

Another embodiment is a lighting device. The lighting device includes a light source and a photoluminescent plate disposed over the light source. The photoluminescent plate may include a base layer transmitting light, a first phosphor layer which is disposed on one surface of the base layer and includes a first phosphor, and a second phosphor layer which is disposed on the other surface of the base layer and includes a second phosphor.

Further another embodiment is a lighting device. The lighting device includes a housing and a light source received in the housing. The light source may include a substrate, a light emitting device disposed on the substrate, and a photoluminescent layer which is disposed on the substrate in such a manner as to be adjacent to the light emitting device and includes at least one phosphor.

Also, the first roughness may be uniformly or non-uniformly formed on the one surface of the base layer.

Also, the photoluminescent plate and the light source may be spaced apart from each other by as much as an arbitrary distance belonging to an overlapped interval between a luminous flux peak interval depending on a distance from the photoluminescent plate to the light source and a saturation interval of the correlated color temperature, which depends on the distance.

Also, the photoluminescent plate and the light source may be spaced apart from each other by 5 to 10 mm.

Also, the base layer may further include a function of diffusing light.

Also, the first phosphor layer may further include at least one of a diffusing agent, an antifoaming agent, an additive and a curing agent.

Also, the first phosphor layer may include at least one of a yellow, red, green and blue phosphor.

Also, the base layer may further include a diffusing agent.

Also, the lighting device according to the embodiment may further include a reflector disposed to surround the light source.

Also, the lighting device according to the embodiment may further include a housing which receives the photoluminescent plate, the light source and the reflector and radiates heat from the light source.

Also, the photoluminescent plate may be convex.

Also, the photoluminescent plate may further include a second phosphor layer which is disposed on the other surface of the base layer and which includes a second phosphor.

Also, the first phosphor layer may include a yellow phosphor and the second phosphor layer may include a red phosphor.

Also, the other surface of the base layer may have a second roughness.

Also, the first roughness and the second roughness may be different from each other.

Also, the light source may include a substrate, a light emitting device disposed on the substrate, and a photoluminescent layer which is disposed on the substrate in such a manner as to be adjacent to the light emitting device and includes at least one phosphor.

Also, at least one of the one surface or the other surface of the base layer may have a roughness.

BRIEF DESCRIPTION OF THE DRAWINGS

Arrangements and embodiments may be described in detail with reference to the following drawings in which like reference numerals refer to like elements and wherein.

DETAILED DESCRIPTION

Hereafter, an embodiment will be described in detail with reference to the accompanying drawings. However, it can be easily understood by those skilled in the art that the accompanying drawings are described only for easily disclosing the contents of the present invention and the scope of the present invention is not limited to those of the accompanying drawings.

A criterion for "on" and "under" of each layer will be described based on the drawings. A thickness or a size of each layer may be magnified, omitted or schematically shown for the purpose of convenience and clearness of description. The size of each element may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

Further, throughout the specification, when it is mentioned that a portion is "connected" to another portion, it includes not only "is directly connected" but also "electrically connected" with another element placed therebetween. Additionally, when it is mentioned that a portion "includes" an element, it means that the portion does not exclude but further includes other elements unless there is a special opposite mention.

Hereafter, a lighting device according to an embodiment will be described with reference to the accompanying drawings.

Figure 1:
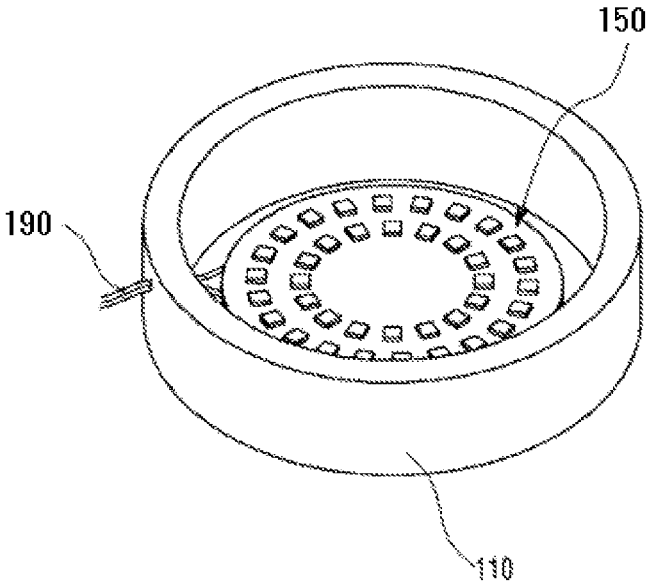
FIG. 1 is a perspective view of a lighting device according to an embodiment.

FIG. 1 is a perspective view of a lighting device according to an embodiment. Referring to FIG. 1, the lighting device according to the embodiment may include a housing 110 and a light source module 150.

The housing 110 forms an external appearance of the lighting device according to the embodiment. The housing 110 receives the light source module 150 therein.

The inner wall of the housing 110 may be inclined unlike the outer wall thereof. When the inner wall of the housing 110 is inclined, the housing 110 is able to reflect light upward in FIG. 1, which travels toward the inner wall of the housing 110 among light emitted from the light source module 150. Therefore, the inner wall of the housing 110 may be applied or deposited with a light reflective material.

The housing 110 may be formed of a material capable of receiving and easily radiating outward heat generated from the light source module 150. For example, the housing 110 may be formed of aluminum or an alloy including aluminum.

The housing 110 may include a hole through which a wire 190 passes. The wire 190 transmits external electric power to the light source module 150.

The light source module 150 is received in the housing 110. Then, the light source module 150 is electrically connected to the wire 190 and receives an electric power from the outside. More specifically, the light source module 150 will be described in detail with reference to FIGS. 2 to 3.

Figure 2:
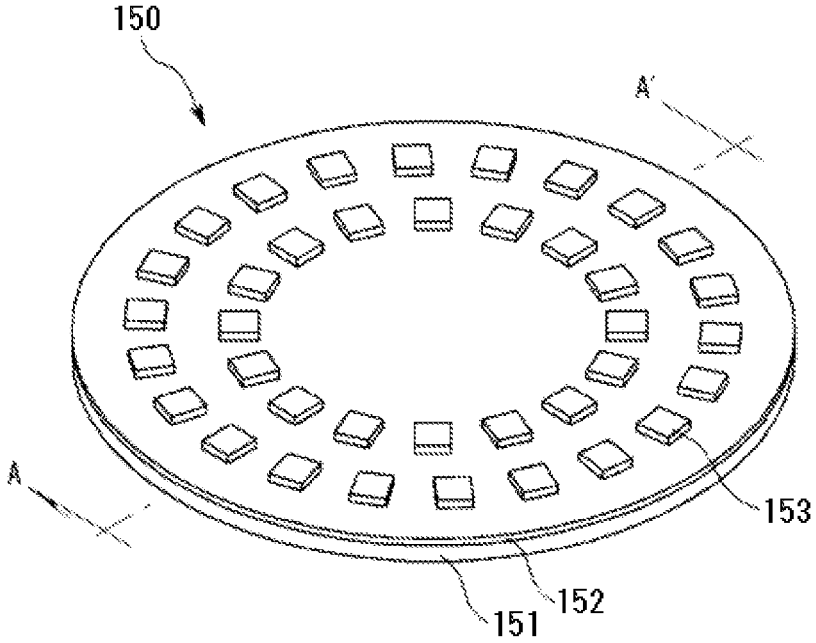
FIG. 2 is a perspective view of a light source module shown in FIG. 1.
Figure 3:
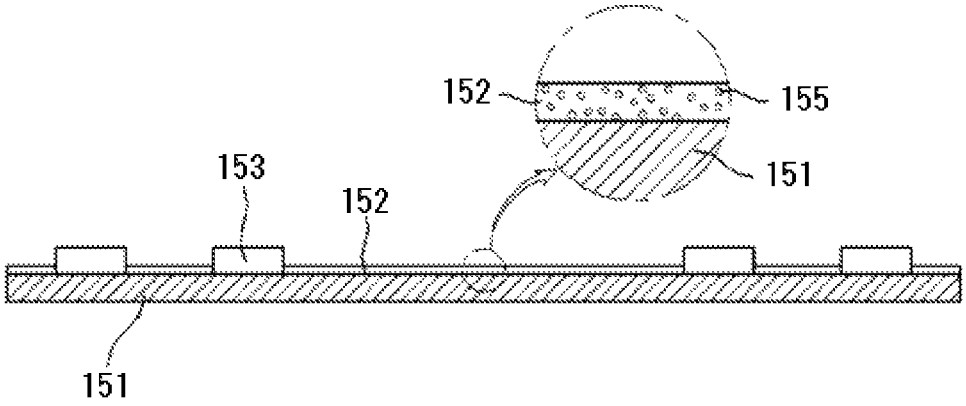
FIG. 3 is a cross sectional view of FIG. 2 taken along line A-A'.

FIG. 2 is a perspective view of a light source module 150 shown in FIG. 1. FIG. 3 is a cross sectional view of FIG. 2 taken along line A-A'.

Referring to FIGS. 2 to 3, the light source module 150 may include a substrate 151, a photoluminescent layer 152 and a light emitting device 153.

The substrate 151 is disposed in the housing 110. One or more light emitting devices 153 are disposed on the substrate 151. The photoluminescent layer 152 is disposed on the substrate 151.

The substrate 151 may be formed by printing a circuit pattern on an insulator. For example, the substrate 151 may be any one of a common printed circuit board (PCB), a metal core PCB, a flexible PCB and a ceramic PCB. The substrate 151 may have a chips on board (COB) type allowing an unpackaged LED chip to be directly bonded thereon.

The substrate 151 may be also formed of a material capable of efficiently reflecting light, or the surface of the substrate 151 may have color capable of efficiently reflecting light, for example, white and silver and the like.

The substrate 151 may be formed of any one selected from a group consisting of polycarbonate (PC), polymethyl methacrylate, (PMMA), polyethylene terephthalate (PET), polyethylene naphthalate (PEN), an acrylic resin and polystyrene (PS) and the like. Here, when the substrate 151 is required to have thermal resistance and chemical resistance, the substrate 151 may be formed of the polycarbonate (PC).

The photoluminescent layer 152 is disposed on the substrate 151 and reflects light from the light emitting device 153. The photoluminescent layer 152 includes at least one phosphor 155. Specifically, the photoluminescent layer 152 is disposed between a plurality of the light emitting devices 153 on the substrate 151. Here, the photoluminescent layer 152 can be easily separated from the substrate 151 and may be formed integrally with the substrate 151 by being coated on the substrate 151.

The photoluminescent layer 152 may be formed of at least one of resin materials. The photoluminescent layer 152 may be formed of a silicone resin among the resin materials.

The photoluminescent layer 152 includes at least one phosphor 155. The phosphor 155 excites light. For example, the phosphor 155 may be included in a coating layer 133 by being mixed with the liquefied coating layer 133 and being agitated through use of an agitator.

The light emitting device 153 may be a light emitting diode (hereafter, referred to as LED), and is not limited to this. The LED may be a red, green, blue or white LED emitting red, green, blue or white light respectively. The kind and number of the LEDs are not limited.

The plurality of the light emitting devices 153 may be radially disposed on the substrate 151. In this case, heat generated from the operation of the lighting device can be efficiently radiated.

The phosphor 155 excites the light from the light emitting device 153 and emits the excited light. Here, the phosphor 155 may be any one of a yellow, green or red phosphor and may be a red one among them. Therefore, the phosphor 155 may be a nitride based phosphor and a sulfide based phosphor. Here, CaS:Eu may be representatively used as the sulfide based inorganic phosphor.

The photoluminescent layer 152 may further include the yellow or green phosphor as well as the red phosphor 155. When the photoluminescent layer 152 further includes the yellow or green phosphor, the included phosphor may be at least one of a silicate based phosphor, the sulfide based phosphor, a YAG based phosphor and a TAG based phosphor. Meanwhile, at least one of SrS:Eu and MgS:Eu of the sulfide based phosphor may be used as the yellow phosphor. $SrGa_2S_4$ and $Eu_2$+ of the sulfide based phosphor may be used as the green phosphor.

The photoluminescent layer 152 may further include at least one of a diffusing agent, an antifoaming agent, an additive and a curing agent.

The diffusing agent is able to diffuse light incident on the photoluminescent layer 152 by scattering the light. The diffusing agent may include, for example, at least any one of $SiO_2$, $TiO_2$, ZnO, $BaSO_4$, $CaSO_4$, $MgCO_3$, $Al(OH)_3$, synthetic silica, glass beads and diamond. However the diffusing agent is not limited to this.

The antifoaming agent is able to obtain reliability by removing foams within the photoluminescent layer 152. Particularly, the antifoaming agent is able to solve a foaming problem caused at the time of applying the photoluminescent layer 152 on the substrate 151 by a screen printing method. The antifoaming agent may include, for example, octanol, cyclohexanol, ethylene glycol or various surfactants. However, the kind of the antifoaming agent is not limited to this.

The curing agent is able to cure the photoluminescent layer 152.

The additive may be used to uniformly distribute the phosphor 155 in the photoluminescent layer 152.

Meanwhile, the photoluminescent layer 152 may be disposed on the inner wall of the housing 110 instead of being disposed on the substrate 151.

Figure 4:
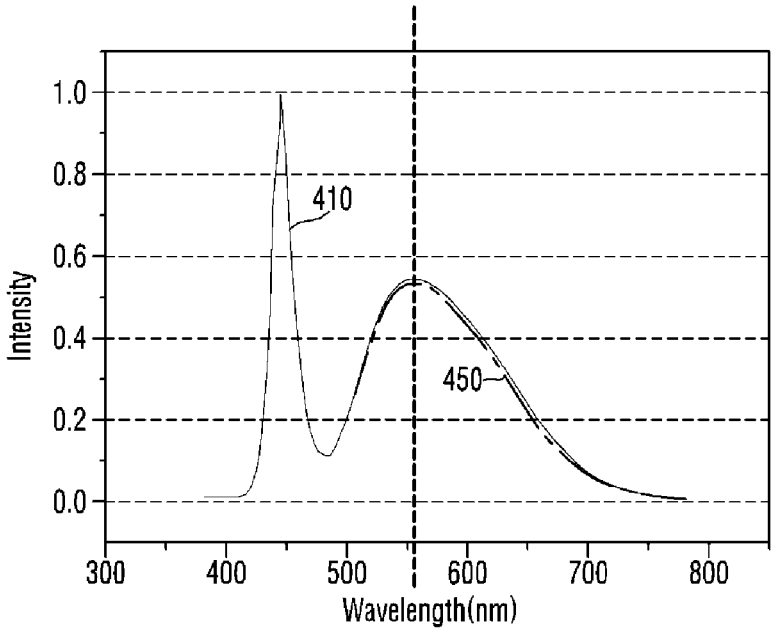
FIG. 4 is a graph showing luminous intensity with respect to the wavelength of the lighting device shown in FIG. 1 and showing luminous intensity with respect to the wavelength of the lighting device without a photoluminescent layer shown in FIG. 1.

FIG. 4 is a graph showing luminous intensity with respect to the wavelength of the lighting device shown in FIG. 1 and showing luminous intensity with respect to the wavelength of the lighting device without a photoluminescent layer 152 shown in FIG. 1.

In FIG. 4, a first curve 410 shows a result of an experiment in which a general optical plate is disposed on the light source module 150 in the lighting device shown in FIGS. 1 to 3. A second curve 450 shows a result of the aforementioned experiment performed without the photoluminescent layer 152. That is, the two curves 410 and 450 shown in FIG. 4 are graphs showing results of the aforementioned experiment performed with and without the photoluminescent layer 152. A general blue LED is used as the light emitting device 153 of the light source module 150.

Referring to FIG. 4, it can be found that the lighting device including the photoluminescent layer 152, that is to say, the lighting device according to the embodiment of the present invention produces an effect of improving luminous intensity in a long wavelength region as compared with a general lighting device which includes no photoluminescent layer 152.

Also, it can be seen that the lighting device according to the embodiment of the present invention has a lower correlated color temperature (CCT) and an improved color rendering index (CRI) in comparison with the general lighting device.

Hereafter, a lighting device according to another embodiment will be described in detail with reference to the accompanying drawings.

Figure 5:
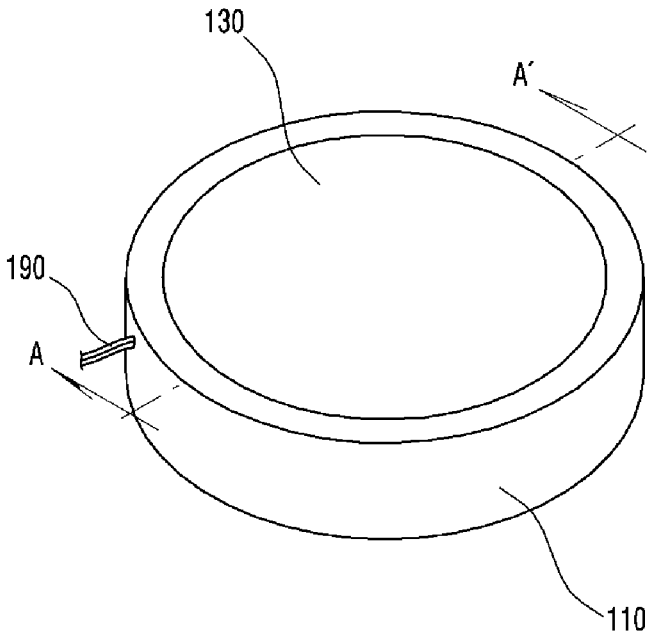
FIG. 5 is a perspective view of a lighting device according to another embodiment.
Figure 6:
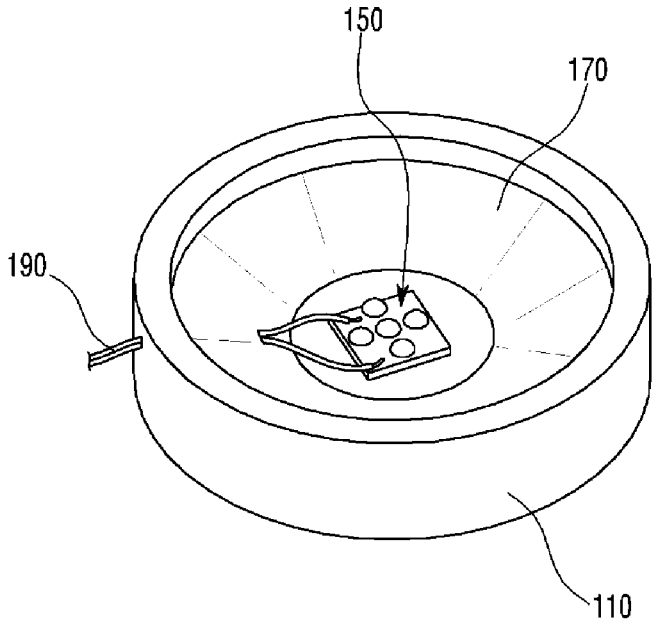
FIG. 6 is a perspective view of the lighting device shown in FIG. 5 without a photoluminescent plate.
Figure 7:
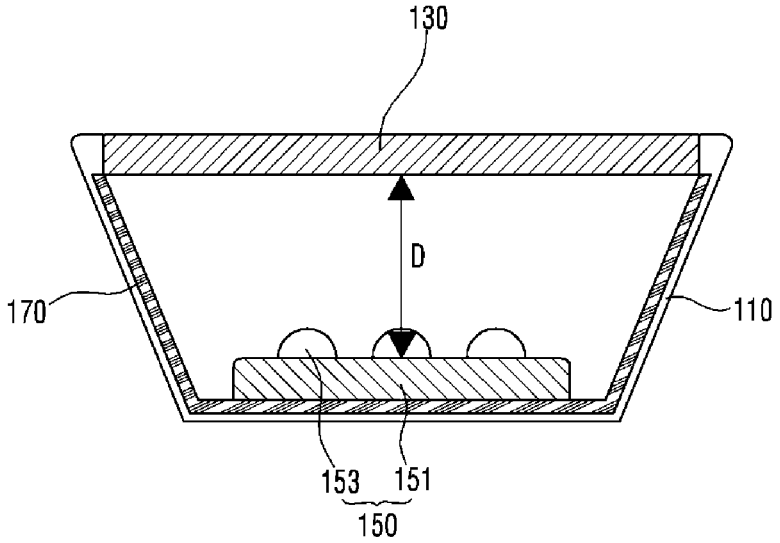
FIG. 7 is a cross sectional view of FIG. 5 taken along line A-A'.

FIG. 5 is a perspective view of a lighting device according to another embodiment. FIG. 6 is a perspective view of the lighting device shown in FIG. 5 without a photoluminescent plate. FIG. 7 is a cross sectional view of FIG. 5 taken along line A-A'.

Referring to FIGS. 5 to 7, the lighting device according to the another embodiment may include the housing 110, a photoluminescent plate 130, the light source module 150 and a reflector 170. The lighting device shown in FIG. 5 according to the another embodiment has an advantage of more improving the correlated color temperature and the color rendering index (CRI) by further adding the photoluminescent plate 130 to the lighting device shown in FIG. 1.

The housing 110 forms an external appearance of the lighting device according to the embodiment. The housing 110 receives the photoluminescent plate 130, the light source module 150 and the reflector 170. The light source module 150 is disposed on the bottom surface of the inside of the housing 110. The photoluminescent plate 130 is disposed on the top of the housing 110.

The housing 110 may include a hole through which a wire 190 passes. The wire 190 transmits external electric power to the light source module 150.

The housing 110 may be formed of a material capable of receiving and easily radiating outward heat generated from the light source module 150. For example, the housing 110 may be formed of aluminum or an alloy including aluminum.

The light source module 150 may be disposed on the bottom surface of the inside of the housing 110. The light source module 150 may include a substrate 151 and a light emitting device 153. A plurality of the light emitting devices 153 may be on one side of the substrate 151. The reflector 170 may be disposed on the other side of the substrate 151. Here, the substrate 151 may be disposed on the housing 110. That is, when the reflector 170 is disposed only on the inner surface of the housing 110, the substrate 151 may be disposed to come in direct surface contact with the housing 110. The substrate 151 can receive an electric power from the outside by being electrically connected to the wire 190.

The photoluminescent plate 130 may be disposed over the light source module 150 and on the top of the housing 110. The photoluminescent plate 130 excites light emitted from the light source module 150. That is, the photoluminescent plate 130 changes the wavelength of the light emitted from the light source module 150.

The reflector 170 is disposed on the housing 110. Here, the reflector 170 may be disposed only on the inner surface of the housing 110.

The reflector 170 reflects the light emitted from the light emitting device 153 of the light source module 150 to the photoluminescent plate 130. Therefore, the reflector 170 may be formed of a material capable of reflecting light.

Hereafter, the photoluminescent plate 130 will be described in detail with reference to the accompanying drawings.

Figure 8:
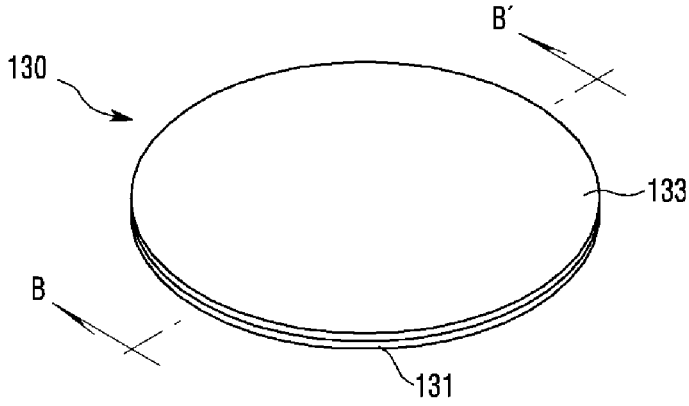
FIG. 8 is a perspective view of the photoluminescent plate shown in FIG. 5.
Figure 9:
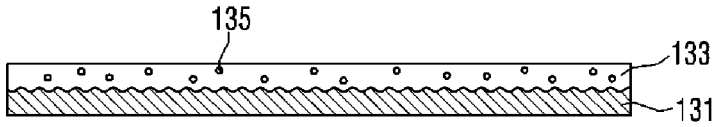
FIG. 9 is a cross sectional view of FIG. 8 taken along line B-B'.
Figure 10:
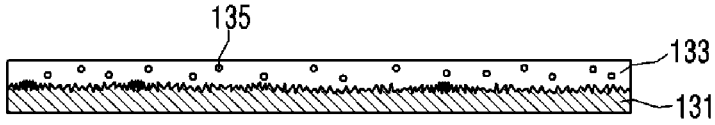
FIG. 10 is a cross sectional view of FIG. 8 taken along line B-B' according to the another embodiment.

FIG. 8 is a perspective view of the photoluminescent plate 130 shown in FIG. 5. FIGS. 9 and 10 are cross sectional views of the photoluminescent plate 130 shown FIG. 8 taken along line B-B'. The embodiment of FIG. 9 is different from that of FIG. 10.

Referring to FIGS. 8 to 10, the photoluminescent plate 130 includes a base layer 131 and a coating layer 133.

The base layer 131 may be formed of a resin material capable of transmitting light. For example, the base layer 131 may be formed of any one selected from a group consisting of a micro lens array (MLA), polycarbonate (PC), polymethyl methacrylate, (PMMA), polyethylene terephthalate (PET), polyethylene naphthalate (PEN), an acrylic resin and polystyrene (PS) and the like. Here, when the base layer 131 is required to have thermal resistance and chemical resistance, the base layer 131 may be formed of the polycarbonate (PC).

The base layer 131 is able to diffuse the light as well as transmits the light. For example, the base layer 131 may be a light transmitting diffuser plate or a light transmitting substrate including a diffusing agent. Here, the diffusing agent may include, for example, at least any one of $SiO_2$, $TiO_2$, ZnO, $BaSO_4$, $CaSO_4$, $MgCO_3$, $Al(OH)_3$, synthetic silica, glass beads and diamond. However the diffusing agent is not limited to this. The size of the diffusing agent's particle may be determined suitable for the diffusion of the light. For example, the particle may have a diameter of 5 μm to 7 μm.

One surface of the base layer 131, as shown in FIGS. 9 and 10 has a predetermined roughness. Here, the one surface may contact with the coating layer 133. The fact that the one surface of the base layer 131 has the predetermined roughness means that a fine uneven structure is, as shown in FIG. 9, uniformly distributed or is, as shown in FIG. 10, non-uniformly distributed on the one surface of the base layer 131.

The coating layer 133 is coated on the one surface of the base layer 131. The coating layer 133 may be formed of at least one of resin materials. The coating layer 133 may be formed of a silicone resin among the resin materials.

The coating layer 133 includes at least one phosphor 135. The phosphor 135 excites light. For example, the phosphor 135 may be included in the coating layer 133 by being mixed with the liquefied coating layer 133 and being agitated through use of an agitator.

The phosphor 135 excites the light from a light source and emits the excited light. The phosphor 135 may be at least one of a silicate based phosphor, a sulfide based phosphor, a YAG based phosphor, a TAG based phosphor and a nitride based phosphor.

The phosphor 135 may include at least one of a yellow, red, green and blue phosphor, each of which emits yellow, red, green and blue light respectively. However, the kind of the phosphor 135 is not limited to this.

Meanwhile, CaS:Eu may be representatively used as the sulfide based inorganic phosphor in order to emit deep red light. At least one of SrS:Eu and MgS:Eu of the sulfide based phosphor may be used as an orange phosphor. $SrGa_2S_4$ and $Eu_2$+ of the sulfide based phosphor may be used as the green phosphor.

Various kinds and amounts of the phosphor 135 may be included in the coating layer 133 in accordance with a light source. For example, when the light source is a white light source, the green and red phosphors may be included in the coating layer 133. When the light source is a blue light source, the green, yellow and red phosphors may be included in the coating layer 133. As such, the kind and amount of the phosphor 135 included in the coating layer 133 may be changed according to the kind of the light source. There is no limit to the kind and amount of the phosphor 135.

Meanwhile, the coating layer 133 may further include at least one of a diffusing agent, an antifoaming agent, an additive and a curing agent.

The diffusing agent is able to diffuse light incident on the coating layer 133 by scattering the light. The antifoaming agent is able to obtain reliability by removing foams within the coating layer 133. The curing agent is able to cure the coating layer 133. The additive may be used to uniformly distribute the phosphor 135 in the coating layer 133.

Meanwhile, the coating layer 133 may be formed by mixing various phosphors or may consist of layers including the red, green and yellow phosphors, which are formed separately from each other. For example, the coating layer 133 may consist of at least one of a first coating film having the red phosphor, a second coating film having the green phosphor and a third coating film having the yellow phosphor.

As such, the photoluminescent plate 130 including the base layer 131 and the coating layer 133 is able to change the wavelength of the light emitted from the light emitting device 153 and then emit the light outside. Therefore, the photoluminescent plate 130 is used as light sources of various lighting apparatuses, a backlight unit, a light emitting device and a display device and the like, so that it is possible to produce light having various wavelengths or to improve the color rendering index (CRI) of the light source.

Since one surface of the base layer 131 of the photoluminescent plate 130 has a predetermined roughness, when the coating layer 133 is coated on the one surface of the base layer 131, the photoluminescent plate 130 can obtain a coating uniformity. Specifically, detailed description thereof will be provided with reference to FIGS. 11 and 12.

Figure 11:
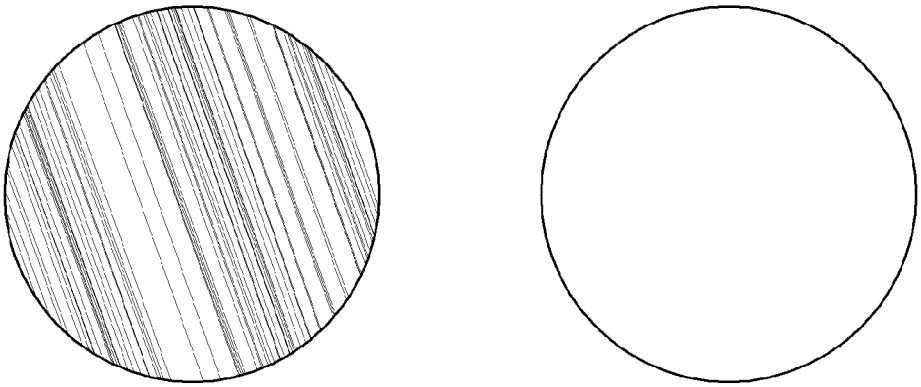
FIG. 11 is a view showing an appearance of a first coating layer when a base layer does not have a predetermined roughness and showing an appearance of a first coating layer when a base layer has a predetermined roughness.
Figure 12:
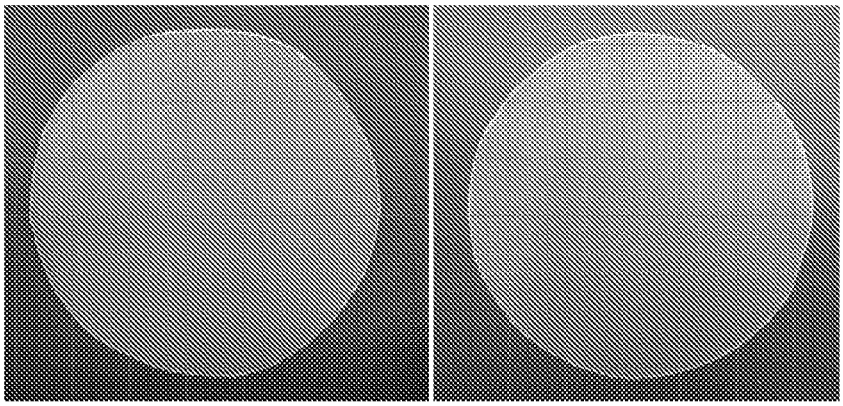
FIG. 12 is a real photograph of FIG. 11.

FIG. 11 is a view showing an appearance of the coating layer 133 when the base layer does not have a predetermined roughness and showing an appearance of the coating layer 133 when the base layer has a predetermined roughness. The figure on the left of FIG. 11 shows an appearance of the coating layer 133 when the base layer does not have a predetermined roughness. The figure on the right of FIG. 11 shows an appearance of the coating layer 133 when the base layer has a predetermined roughness. FIG. 12 is a real photograph of FIG. 11.

Referring to FIGS. 11 and 12, it can be found that the coating layer 133 does not include a coating line when the base layer 131 has a predetermined roughness.

The photoluminescent plate 130 has an excellent adhesiveness. This will be described with reference to FIG. 13.

Figure 13:
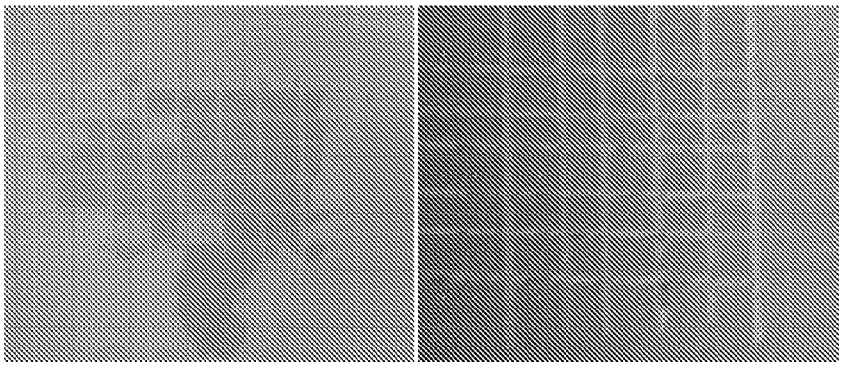
FIG. 13 is a comparison photograph verifying adhesiveness performance of a photoluminescent plate shown in FIG. 8.

FIG. 13 is a comparison photograph verifying adhesiveness performance of a photoluminescent plate 130 shown in FIG. 8. The photograph on the left of FIG. 13 shows an appearance obtained with the predetermined lapse of time after attaching twenty five quadrangular materials, each of which has a size of 1 $mm^2$, on the photoluminescent plate without a predetermined roughness. The photograph on the right of FIG. 13 shows an appearance obtained with the predetermined lapse of time after attaching the twenty five quadrangular materials on the photoluminescent plate 130 shown in FIG. 8.

Through a comparison of the two photographs of FIG. 13, it can be understood that the adhesiveness of the photoluminescent plate 130 shown in FIG. 8 is more than that of the photoluminescent plate without a predetermined roughness.

Also, since the base layer 131 of the photoluminescent plate 130 has a predetermined roughness, the content of the phosphor 135 included in the coating layer 133 is more than the content of the phosphor included in the photoluminescent plate including the coating layer coated on a general substrate which has the same thickness as that of the base layer 131 and does not have the predetermined roughness.

Meanwhile, when the base layer 131 of the photoluminescent plate 130 is a diffuser substrate further having a diffusing function, it is possible to compensate for luminous flux degradation (approximately about 30%) due to the transmittance (approximately about 60%) of the diffuser substrate. Specifically, this will be described with reference to the following Table 1 and Table 2. The same light emitting diode is applied in the experiment related to the following Table 1 and Table 2.

TABLE 1

| Substrate | Number of applied | Lm | CIE | | CCT | Power | Eff. |
|---|---|---|---|---|---|---|---|
| PC | 1 | 353.8 | 0.2040 | 0.1114 | — | 8.64 | 39.6 |
| | 2 | 514.4 | 0.2401 | 0.1758 | — | 8.64 | 63 |
| | 3 | 628.8 | 0.3001 | 0.2759 | 8469 | 8.68 | 69.5 |
| | 4 | 603 | 0.3337 | 0.3324 | 5438 | 8.67 | 72.5 |

Table 1 shows that, regarding the coating layer 133 which is shown in FIG. 8 and coated on a general polycarbonate (PC) substrate having no predetermined roughness, a luminous flux (Lm), a color coordinate (derived from CIE), a correlated color temperature (CCT), power and efficiency (Eff.) when the coating layer 133 is coated one time to four times.

TABLE 2

| Substrate | Number of applied | Lm | CIE | | CCT | Power | Eff. |
|---|---|---|---|---|---|---|---|
| Diffuser Substrate | 1 | 455.3 | 0.2231 | 0.1822 | — | 8.51 | 53.5 |
| | 2 | 635.9 | 0.3040 | 0.3248 | 7043 | 8.65 | 73.5 |
| | 3 | 646.6 | 0.3617 | 0.4240 | 4741 | 8.75 | 73.9 |
| | 4 | 603.8 | 0.3980 | 0.4809 | 4190 | 8.73 | 69.2 |

Table 2 shows that, regarding the base layer 131 of the photoluminescent plate 130 which is shown in FIG. 8 and is a diffuser substrate, a luminous flux (Lm), a color coordinate (derived from CIE), a correlated color temperature (CCT), power and efficiency (Eff.) when the coating layer 133 is coated one time to four times.

For a comparison of Table 1 and Table 2, for example, luminous fluxes are compared when the coating layer 133 is coated on each of the substrates. In case of the polycarbonate (PC) substrate (0.5 T), the luminous flux is 353.8 (Lm). In case of the diffuser substrate, the luminous flux is 455.3 (Lm). Through this experiment, it can be discovered that, while, since the transmittance of the diffuser substrate is less than that of the general polycarbonate (PC) substrate, the luminous flux of the diffuser substrate is smaller than that of the general polycarbonate (PC) substrate, the diffuser substrate has the predetermined roughness, so that it is possible to compensate for the luminous flux degradation. This is because the surface area of the phosphor 135 included in the coating layer 133 is increased due to the roughness.

A manufacturing method of the photoluminescent plate 130 shown in FIG. 8 is as follows. First, a light transmitting base layer 131 having a predetermined roughness is provided. Here, the light transmitting base layer 131 may be a diffuser base layer 131 which further has a light diffusing function.

Then, the phosphor 135 is mixed with a coating solution. The coating solution and the phosphor 135 may be mixed with each other by using an ultrasonic disperser.

Next, the coating solution including the phosphor 135 is also coated on one surface, which has a predetermined roughness, of the light transmitting base layer 131.

Through the aforementioned process, the photoluminescent plate 130 can be manufactured.

A relationship between the photoluminescent plate 130 and the light emitting device 153 will be described with reference to FIG. 7.

Referring to FIG. 7, the photoluminescent plate 130 and the light emitting device 153 may be spaced apart from each other by as much as an arbitrary distance belonging to an overlapped interval between a luminous flux peak interval depending on a distance "D" from the photoluminescent plate 130 to the light emitting device 153 and a saturation interval of the correlated color temperature, which depends on the distance "D". Specifically, a more detailed description thereof will be given below with reference to FIG. 14.

Figure 14:
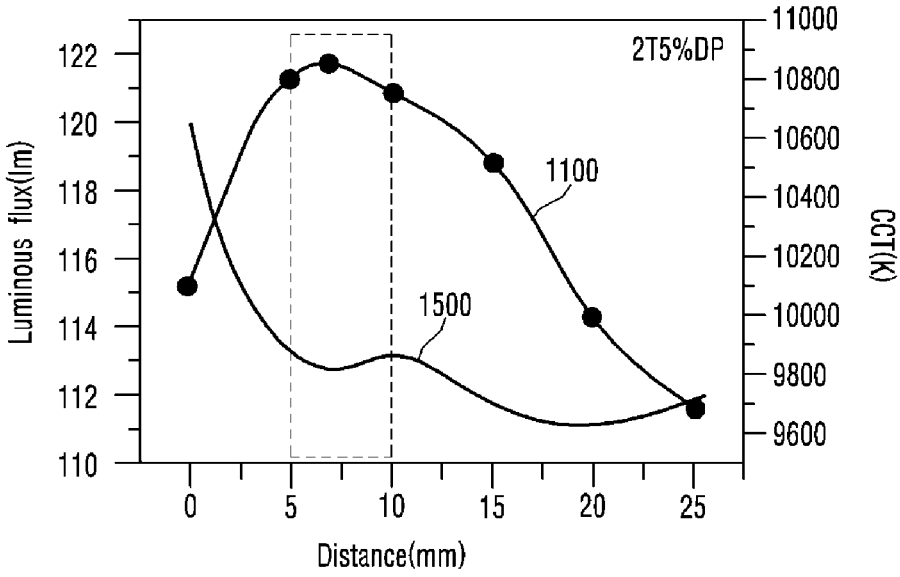
FIG. 14 is a graph showing a luminous flux curve and a correlated color temperature curve with respect to a distance between the photoluminescent plate and a light emitting device.

FIG. 14 is a graph showing a luminous flux curve 1100 and a correlated color temperature curve 1500 with respect to a distance between the photoluminescent plate 130 and the light emitting device 153. Though the graph of FIG. 14 may be changed slightly according to the light emitting device 153 and the photoluminescent plate 130, tendencies of both curves 1100 and 1500 are almost similar to each other. The photoluminescent plate 130 used in the experiment is 2 T 5% DP. 2 T 5% DP means that the thickness of the photoluminescent plate 130 is 2 T (mm), the content of the phosphor is 5%, and the base layer 131 of the photoluminescent plate 130 is a diffuser plate (DP). The experiment has been performed in an integrating sphere.

Here, the graph shown in FIG. 14 is represented by the following Table 3.

TABLE 3

| Distance(mm) | 0 | 5 | 10 | 15 | 20 | 25 |
|---|---|---|---|---|---|---|
| Luminous Flux(lm) | 115 | 121 | 121 | 119 | 114 | 112 |
| CCT(k) | 10857 | 9874 | 9859 | 9721 | 9614 | 9717 |

Referring to the luminous flux curve 1100 shown in FIG. 14, when the distance "D" between the photoluminescent plate 130 and the light emitting device 153 is greater than a certain distance, the luminous flux according to the distance "D" incurs an optical loss due to the collisions between radiations emitted from the light emitting device 153. Regarding the luminous flux curve 1100, the luminous flux has a peak interval when the distance "D" is within a range between 5 mm and 10 mm. Therefore, it can be seen that the optical loss occurs when the distance "D" is greater than about 6 mm.

Referring to the correlated color temperature curve 1500 shown in FIG. 14, when the distance "D" between the photoluminescent plate 130 and the light emitting device 153 is greater than a certain distance, the correlated color temperature curve 1500 has an interval in which the correlated color temperature (CCT) according to the distance "D" does not decrease. That is, the correlated color temperature curve 1500 has a saturation interval. Regarding the correlated color temperature curve 1500, it can be seen that the correlated color temperature curve 1500 has the saturation interval when the distance "D" is greater than about 5 mm.

Therefore, the photoluminescent plate 130 and the light emitting device 153 may be spaced apart from each other by as much as the optimum distance "D", i.e., an arbitrary distance belonging to an overlapped interval between the peak interval of the luminous flux and the saturation interval of the correlated color temperature.

Hereafter, the another embodiment of the photoluminescent plate 130 shown in FIG. 5 will be described in detail with reference to the accompanying drawings.

Figure 15:
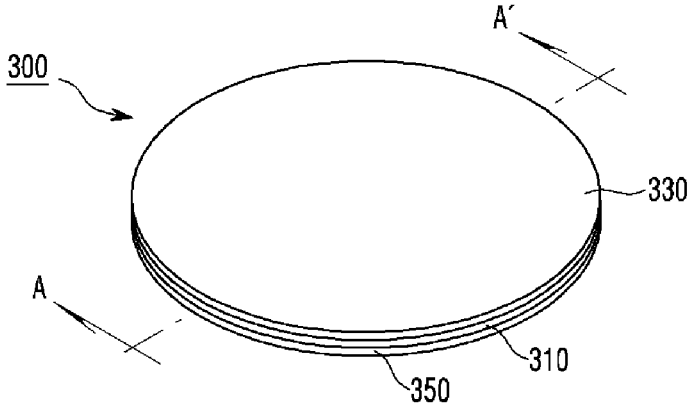
FIG. 15 is a perspective view of the photoluminescent plate shown in FIG. 5 according to the another embodiment.
Figure 16:
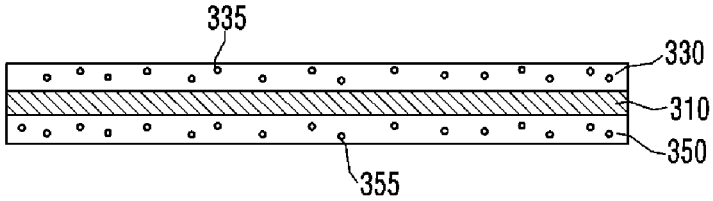
FIG. 16 is a cross sectional view of the photoluminescent plate shown in FIG. 15 taken along line A-A'.
Figure 17:
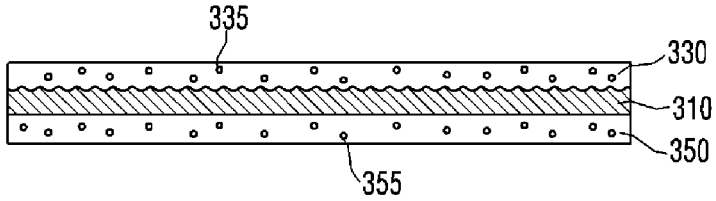
FIG. 17 is a cross sectional view of the photoluminescent plate according to the another embodiment shown in FIG. 15 taken along line A-A'.
Figure 18:
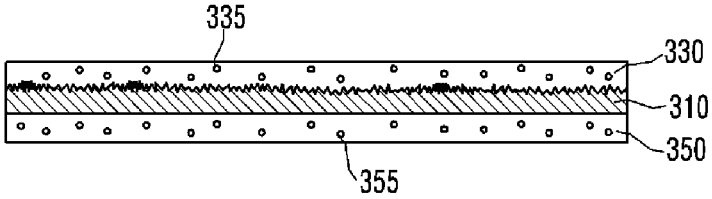
FIG. 18 is a cross sectional view of the photoluminescent plate according to further another embodiment shown in FIG. 15 taken along line A-A'.

FIG. 15 is a perspective view of the photoluminescent plate 130 shown in FIG. 5 according to the another embodiment. FIGS. 16 to 18 are cross sectional views of a photoluminescent plate 300 shown in FIG. 15 taken along line A-A'. FIGS. 16 to 18 show embodiments different from one another.

Referring to FIGS. 15 to 18, a photoluminescent plate 300 includes a base layer 310, a first coating layer 330 and a second coating layer 350. Hereafter, the base layer 310, the first and the second coating layers 330 and 350 will be described respectively.

One surface of the base layer 310, as shown in FIG. 17, has a predetermined roughness. Here, the one surface may contact with the first coating layer 330 or the second coating layer 350.

Here, the fact that the base layer 310 has the predetermined roughness means that a fine uneven structure is, as shown in FIG. 17, uniformly distributed or is, as shown in FIG. 18, non-uniformly distributed on the one surface of the base layer 310.

The first coating layer 330 is coated on one surface of the base layer 310. The second coating layer 350 is coated on the other surface of the base layer 310.

The first coating layer 330 may include at least one phosphor 335 and the second coating layer 350 may also include at least one phosphor 355. The phosphors 335 and 355 excite light.

The phosphor 335 included in the first coating layer 330 may be the same as or different from the phosphor 355 included in the second coating layer 350.

The phosphors 335 and 355 may include at least one of a yellow, red, green and blue phosphor, each of which emits yellow, red, green and blue light respectively. However, the kinds of the phosphors 335 and 355 are not limited to this.

Various kinds and amounts of the phosphors 335 and 355 may be included in the first and the second coating layers 330 and 350 respectively.

According to the embodiment, the first coating layer 330 may include a yellow phosphor 335 and the second coating layer 350 may include a red phosphor 355. Here, the yellow phosphor 335 may be any one of the YAG based phosphor, the silicate based phosphor or the oxynitride based phosphor. At least one of SrS:Eu and MgS:Eu of the sulfide based phosphor may be used as the yellow phosphor 335. The red phosphor 355 may be any one of the nitride based phosphor or the sulfide based phosphor. CaS:Eu may be used as the sulfide based inorganic phosphor.

The first coating layer 330 may further include a green phosphor as well as the yellow phosphor 335. The green phosphor may be any one of the silicate based phosphor or the oxynitride based phosphor. $SrGa_2S_4$ and $Eu_2$+ of the sulfide based phosphor may be used as the green phosphor. Various amounts of the phosphors 335 and 355 may be included in the first and the second coating layers 330 and 350 in accordance with a light source.

Particularly, since one surface of the base layer 310 of the photoluminescent plate 300 shown in FIGS. 17 to 18 has the predetermined roughness, when the coating layer 330 is coated on the base layer 310, the photoluminescent plate 300 can obtain a coating uniformity.

Also, since one surface of the base layer 310 of the photoluminescent plate 300 shown in FIGS. 17 to 18 has the predetermined roughness, the photoluminescent plate 300 has an excellent adhesiveness.

Also, since one surface of the base layer 310 of the photoluminescent plate 300 shown in FIGS. 17 to 18 has the predetermined roughness, the content of the phosphor 335 included in the first coating layer 330 is more than the content of the phosphor included in the photoluminescent plate including the first coating layer coated on a general base layer which has the same thickness as that of the base layer 131 and does not have the predetermined roughness.

Also, since both surfaces of the base layer 310 of the photoluminescent plate 300 shown in FIGS. 17 to 18 are coated with the first and the second coating layers 330 and 350 respectively, the photoluminescent plate 300 can be prevented from being curved. When the photoluminescent plate 300 including the base layer 310 of which only one surface is coated with the coating layer is disposed over the light source, stress is generated in the coating layer by heat from the light source, and the photoluminescent plate 300 may be curved by the stress. However, since the photoluminescent plate 300 includes the base layer 310 of which both surfaces are coated with the first and the second coating layers 330 and 350, it is possible to prevent the photoluminescent plate 300 from being curved due to the heat from the light source module.

Meanwhile, in the photoluminescent plate 300 shown in FIGS. 16 to 18, the phosphors 335 and 355 included in the first coating layer 330 and the second coating layer 350 respectively may be different from each other. For example, the phosphor 335 included in the first coating layer 330 may be a yellow phosphor and the phosphor 355 included in the second coating layer 350 may be a red phosphor. When the first coating layer 330 includes the yellow phosphor 335 and the second coating layer 350 includes the red phosphor 355, the degree of dispersion of the phosphor can be enhanced. When the yellow phosphor and the red phosphor are mixed with each other in one coating layer, the yellow phosphor and the red phosphor are not appropriately dispersed in the one coating layer due to the specific gravity difference between the yellow phosphor and the red phosphor. However, the photoluminescent plate 300 shown in FIGS. 16 to 18 includes the first and the second coating layers 330 and 350 both of which have the mutually different phosphors. Accordingly, it is possible to easily disperse the phosphors.

Figure 19:
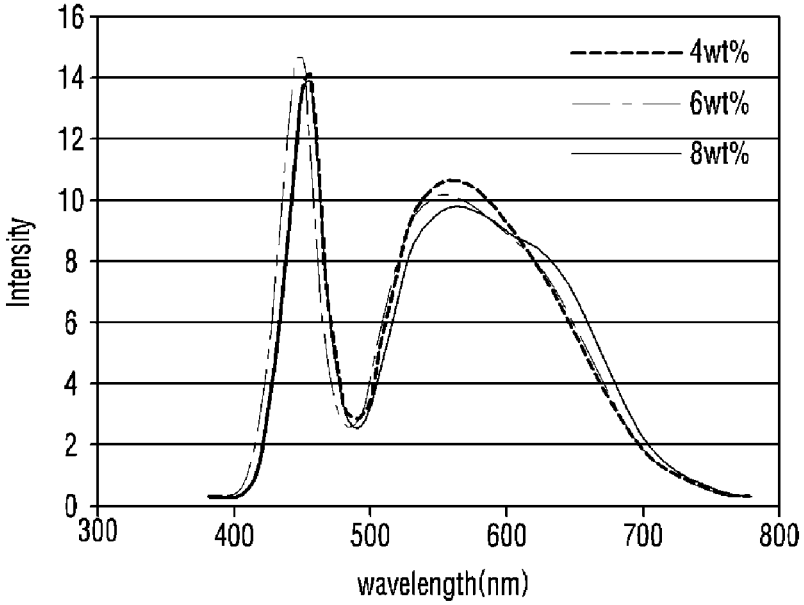
FIGS. 19 to 21 are graphs showing experimental results of a luminous intensity, a correlated color temperature (CCT) and a color coordinate (derived from CIE) according to the content increase of a red phosphor of the photoluminescent plate shown in FIG. 17 or 18.
Figure 20:
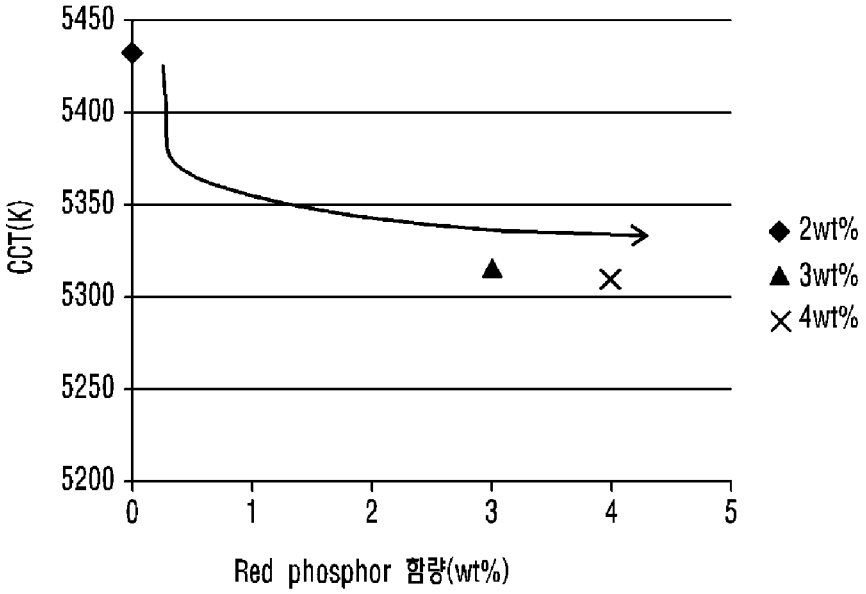
Figure 21:
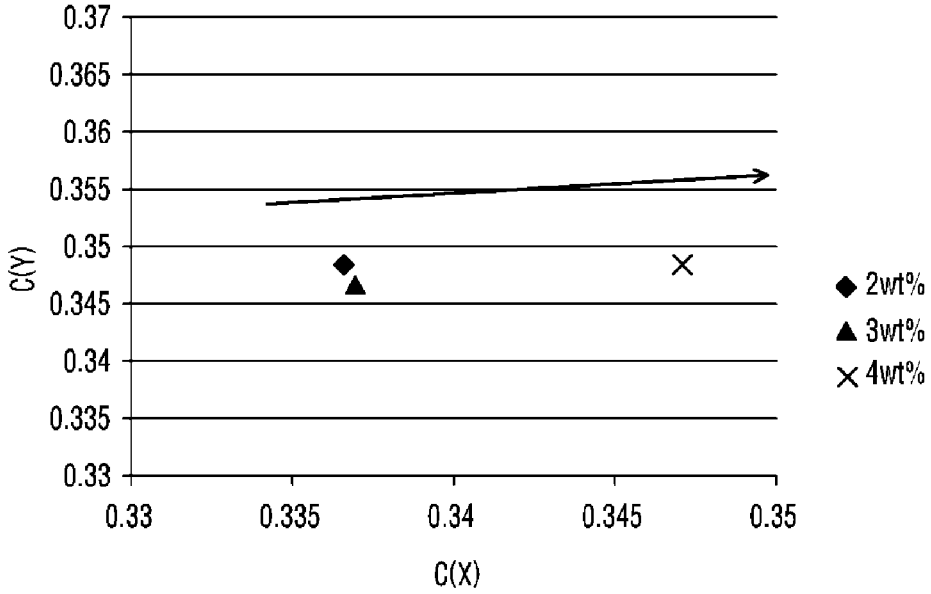

FIGS. 19 to 21 show experimental results of the luminous intensity, the correlated color temperature (CCT) and the color coordinate (derived from CIE) in accordance with the content increase of the red phosphor of the photoluminescent plate 300 shown in FIGS. 17 and 18. When the first coating layer 330 of the photoluminescent plate 300 includes the yellow phosphor 335 and the second coating layer 350 of the photoluminescent plate 300 includes the red phosphor 355, the graphs of FIGS. 19 to 21 show that the changes of the luminous intensity, the correlated color temperature (CCT) and the color coordinate (derived from CIE) in accordance with the content increase of the red phosphor 355. The experiments of FIGS. 19 to 21 use the light source of COB PKG of 445 nm, a driving current of 500 mA and the base layer 310 of MLA of 80 um.

Referring to FIG. 19, it can be found that the luminous intensity increases with the increase of the content of the red phosphor 355 in a long wavelength region (greater than 600 nm). Referring to FIG. 20, it can be found that the correlated color temperature (CCT) decreases with the increase of the content of the red phosphor 355. Referring to FIG. 21, it can be found that the color coordinate (derived from CIE) moves in the increase direction of Y-component of the coordinate with the increase of the content of the red phosphor 355. Though not shown in the drawing, it can be found that the color rendering index (CRI) increases with the increase of the content of the red phosphor 355.

Meanwhile, the first coating layer 330 shown in FIGS. 16 to 18 may further include a green phosphor as well as the yellow phosphor 335. In this case, since the specific gravities of the yellow phosphor 335 and the green phosphor are different from each other, they may not be well mixed with each other. Therefore, the first coating layer 330 may consist of a first coating film including the yellow phosphor 335 and a second coating film including the green phosphor.

Figure 22:
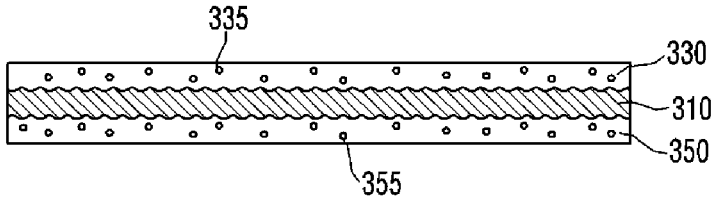
FIGS. 22 to 24 are cross sectional views of the photoluminescent plate according to the another embodiment shown in FIG. 15.
Figure 23:
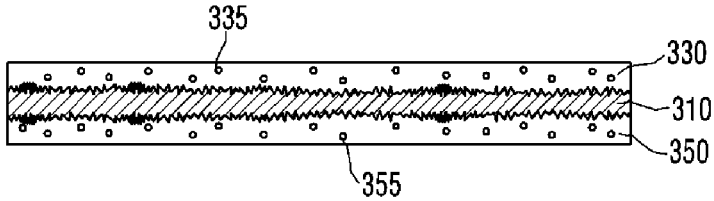
Figure 24:
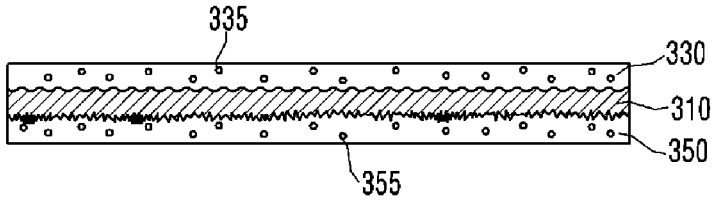

FIGS. 22 to 24 are cross sectional views of the photoluminescent plate 300 according to the another embodiment shown in FIG. 15.

Referring to FIGS. 22 to 24, both surfaces of the base layer 310 of the photoluminescent plate 300 have a predetermined roughness. Specifically, both surfaces of the base layer 310 of the photoluminescent plate 300 shown in FIG. 22 have a uniform roughness. Both surfaces of the base layer 310 of the photoluminescent plate 300 shown in FIG. 23 have a non-uniform roughness. While both surfaces of the base layer 310 of the photoluminescent plate 300 shown in FIG. 24 have a roughness, one surface has a uniform roughness and the other surface has a non-uniform roughness.

The photoluminescent plates 300 shown in FIGS. 22 to 24 are fully expected to have the features of the photoluminescent plates 300 shown in FIGS. 16 and 18 as they are.

Meanwhile, the first and the second coating layers 330 and 350 shown in FIGS. 16 to 18 and 22 to 24 may further include at least one of a diffusing agent, an antifoaming agent, an additive and a curing agent.

Meanwhile, the first and the second coating layers 330 and 350 may be formed by mixing various phosphors or may consist of layers including the red, green and yellow phosphors, which are formed separately from each other.

As such, the photoluminescent plate 300 including the base layer 310 and the first and the second coating layers 330 and 350 is able to change the wavelength of the light emitted from the light source and to be prevented from being curved due to the heat from the light source.

A manufacturing method of the photoluminescent plate 300 according to the embodiment of the present invention shown in FIGS. 16 to 18 is as follows. First, a light transmitting base layer 310 is provided. Here, one surface of the light transmitting base layer 310 of the photoluminescent plate 300 shown in FIGS. 17 to 18 has a predetermined roughness. Both surfaces of the light transmitting base layer 310 of the photoluminescent plate 300 shown in FIGS. 22 to 24 have a predetermined roughness. The light transmitting base layer 310 may be a diffuser base layer 310 which further has a light diffusing function.

Then, the yellow phosphor 335 is mixed with a first coating solution and the red phosphor 355 is mixed with a second coating solution. The first and the second coating solution and the phosphors 335 and 355 may be mixed with each other by using an ultrasonic disperser.

Next, the first coating solution including the yellow phosphor 335 is coated on one surface of the light transmitting base layer 310. The second coating solution including the red phosphor 355 is coated on the other surface of the light transmitting base layer 310.

Through the aforementioned process, the photoluminescent plate 300 shown in FIGS. 16 to 18 or 22 to 24 can be manufactured.

As shown in FIGS. 5 to 6, the photoluminescent plate 300 may be disposed on the light source module 150. Here, arrangements of the photoluminescent plate 300 and the light source module 150 will be described with reference to the drawing.

Figure 25:
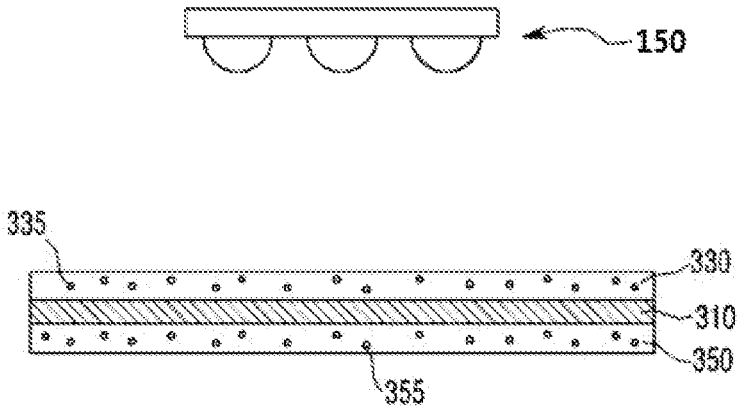
FIG. 25 is a view for describing an arrangement structure of the photoluminescent plate and a light source module shown in FIGS. 5 to 6.

FIG. 25 is a view for describing an arrangement structure of the photoluminescent plate 300 and the light source module 150. It should be noted that the photoluminescent plate 300 of FIG. 25 is the photoluminescent plate 300 of FIG. 16 but can be used as the photoluminescent plate 300 shown in FIGS. 17 to 18 and 22 to 24 without being limited to FIG. 16.

Referring to FIG. 25, the first coating layer 330 including the yellow phosphor 335 may be disposed on the light source module 150. In other words, the photoluminescent plate 300 may be disposed on the light source module 150 such that the light emitted from the light source module 150 sequentially passes through the first coating layer 330, the base layer 310 and the second coating layer 350.

If the second coating layer 350 is disposed on the light source module 150 emitting blue light by turning upside down the photoluminescent plate 300, the red phosphor 355 having high excitation efficiency excites most of the blue light emitted from the light source module 150 into red light. The excited red light passes through the base layer 310 and reaches the yellow phosphor 335 included in the first coating solution 330. However, the red light is difficult to be excited and turned into white light by the yellow phosphor 335. That is, overall excitation efficiency is deteriorated.

Therefore, regarding the arrangement relationship between the photoluminescent plate 300 and the light source module 150, the photoluminescent plate 300 may be disposed in such a manner that the light emitted from the light source module 150 first passes through the first coating layer 330 including the yellow phosphor 335.

Hereafter, a lighting device according to further another embodiment will be described in detail with reference to the accompanying drawings.

Figure 26:
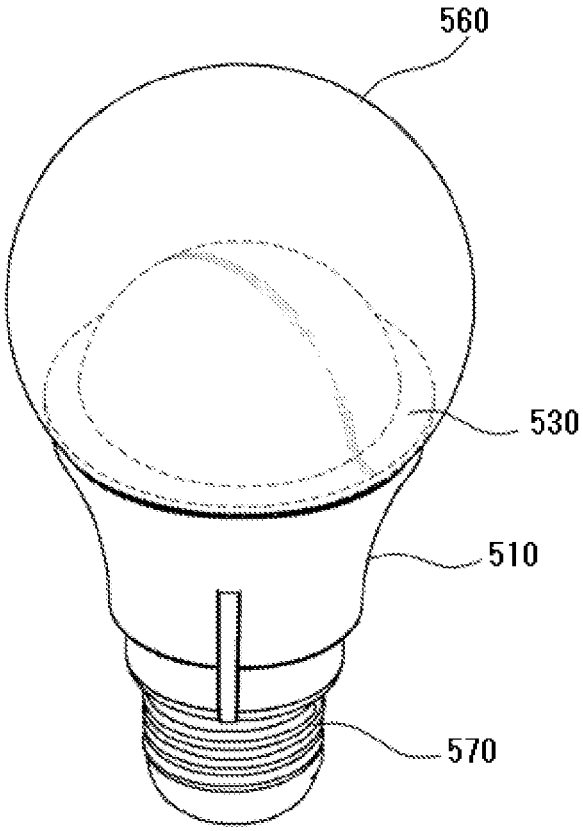
FIG. 26 is a perspective view of a lighting device according to further another embodiment.
Figure 27:
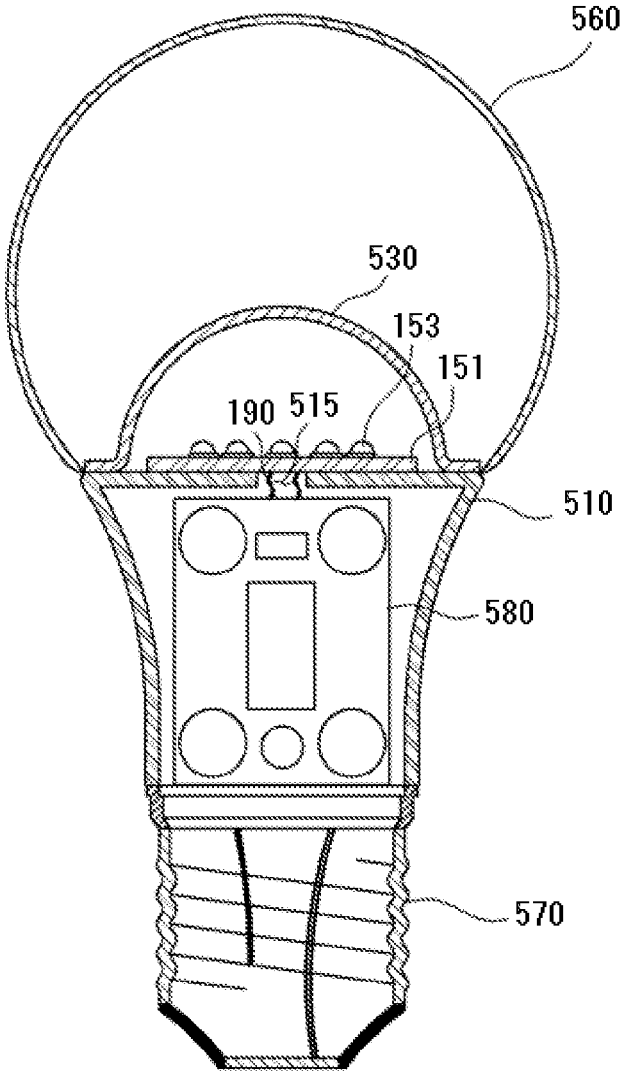
FIG. 27 is a cross sectional view of the lighting device shown in FIG. 26.

FIG. 26 is a perspective view of a lighting device according to further another embodiment. FIG. 27 is a cross sectional view of the lighting device shown in FIG. 26.

Referring to FIGS. 26 and 27, the lighting device according to the further another embodiment may include a housing 510, a substrate 151, a light emitting device 153, a photoluminescent plate 530, a bulb 560, a socket 570 and a power supplier 580. Hereafter, each component will be described in detail.

The substrate 151 including the light emitting device 153 is disposed on the housing 510. The housing 510 receives and radiates heat generated from the light emitting device 153.

The housing 510 has a circular surface in which the substrate 151 is disposed. The housing 510 also receives the power supplier 580 thereinside. The housing 510 may include a hole 515 allowing a wire 190 to pass therethrough. The wire 190 electrically connects the substrate 151 with the power supplier 580.

In order to increase the area for radiating heat, the outer surface of the housing 510 may further include a plurality of heat radiating fms (not shown) extending outward.

The housing 510 may be formed of a metallic material or a resin material which has high heat radiation efficiency. The material of the housing 510 is not limited. For example, the material of the housing 510 may include at least one of Al, Ni, Cu, Ag and Sn.

Though not shown in the drawings, a heat radiating plate may be disposed between the substrate 151 and the housing 510. The heat radiating plate may be formed of a thermal conduction silicon pad or a thermal conductive tape which has a high thermal conductivity. The heat radiating plate is able to effectively transfer the heat generated from the light emitting device 153 to the housing 510.

The substrate 151 may be disposed on the housing 510. One or more light emitting devices 153 may be disposed on the substrate 151.

The photoluminescent plate 530 is disposed to surround the light emitting device 153 and includes at least one phosphor. The photoluminescent plate 530 is upwardly convex. The photoluminescent plate 530 may have a shape almost close to a hemisphere.

The photoluminescent plate 530 excites light having a specific color emitted from the light emitting device 153. For example, when the light emitted from the light emitting device 153 is blue light, the photoluminescent plate 530 is able to change the blue light into white light. The photoluminescent plate 530 will be described in more detail with reference to FIG. 28.

Figure 28:
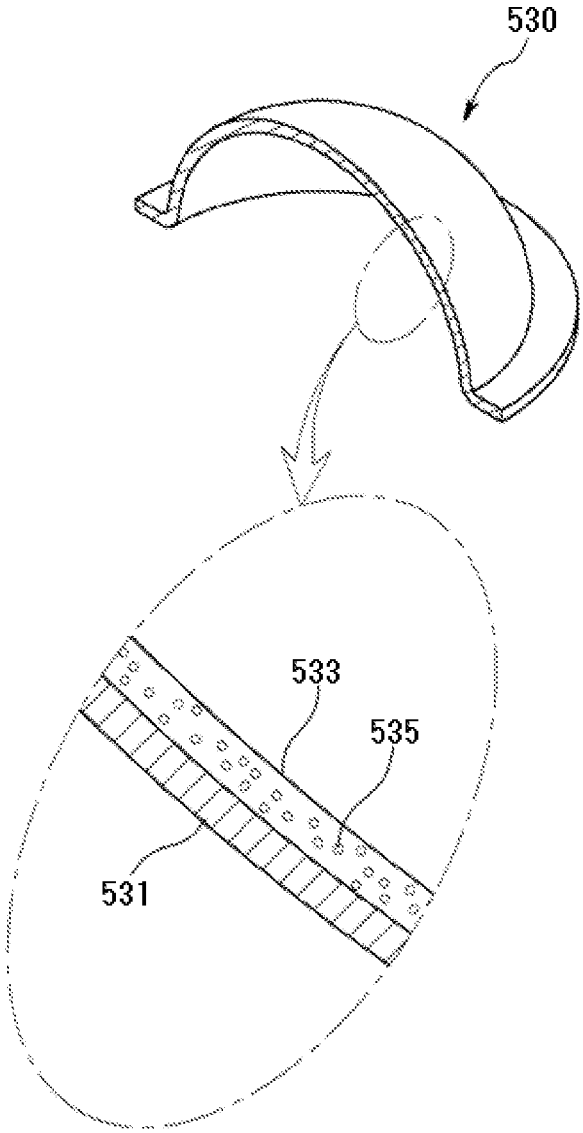
FIG. 28 shows a sectional perspective view and a partial enlarged view of a photoluminescent plate used in the lighting device shown in FIG. 26.

FIG. 28 shows a sectional perspective view and a partial enlarged view of a photoluminescent plate 530 used in the lighting device shown in FIG. 26.

Referring to FIG. 28, the photoluminescent plate 530 may include a base layer 531 and a coating layer 533.

The base layer 531 may be formed of a resin capable of transmitting the light emitted from the light emitting device 153. The base layer 531 may be formed in the same manner as that of the base layer 131 of the embodiment described above.

The coating layer 533 is coated on one surface of the base layer 531. The coating layer 533 may be formed in the same manner as that of the coating layer 133 of the embodiment described above.

The coating layer 533 includes at least one phosphor 535. The phosphor 535 excites the light emitted from the light emitting device 153. The phosphor 535 may be formed in the same manner as that of the phosphor 155 of the embodiment described above.

Also, the photoluminescent plate 530 may be a polymer diffuser plate including a phosphor. Specifically, the photoluminescent plate 530 will be described with reference to the drawings.

Figure 29:
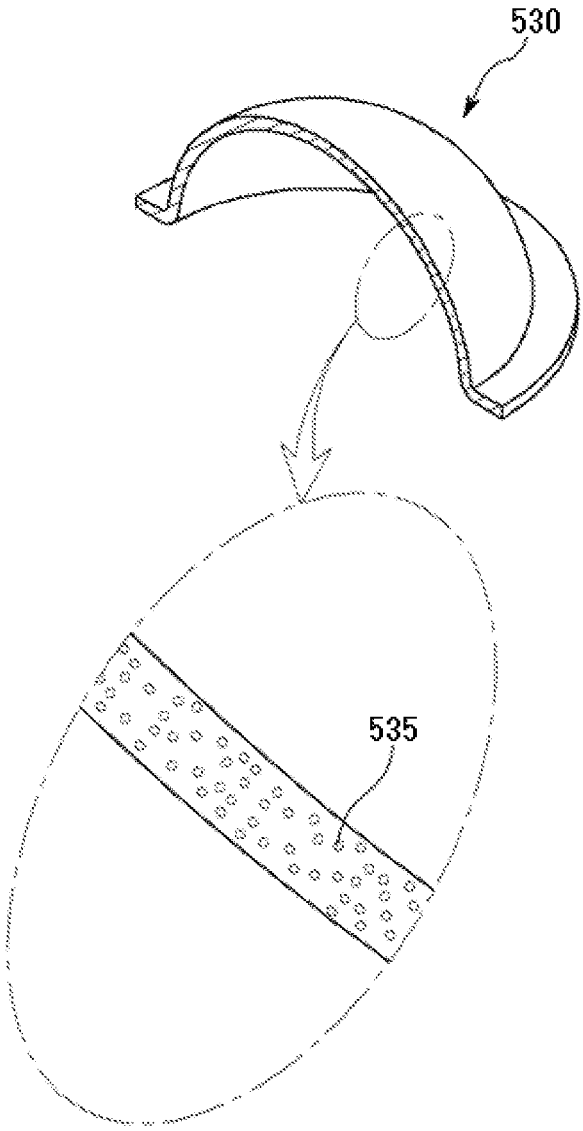
FIG. 29 shows a sectional perspective view and a partial enlarged view of a photoluminescent plate according to the further another embodiment used in the lighting device shown in FIG. 26.

FIG. 29 shows another embodiment of the photoluminescent plate 530 shown in FIG. 26.

Figure 30:
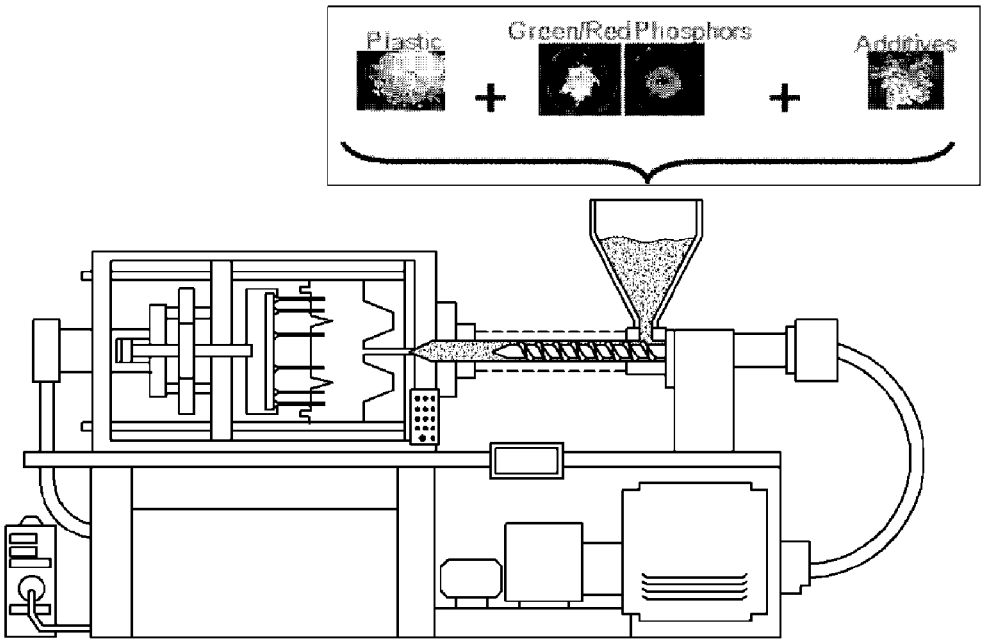
FIG. 30 is a view for describing a manufacturing method of the photoluminescent plate shown in FIG. 29.

Referring to FIG. 29, the photoluminescent plate 530 is a single substrate made of polymer and may include a predetermined phosphor 535. The phosphor 535 may be formed in the same manner as that of the phosphor 155 of the embodiment described above. The polymer substrate 530 may be, as shown in FIG. 30, manufactured by mixing a plastic material with the green/red phosphor and by using a metal injection molding method. Here, the polymer substrate 530 may be also formed by further mixing a diffusing agent as an additive. The diffusing agent may include, for example, at least any one of $SiO_2$, $TiO_2$, ZnO, $BaSO_4$, $CaSO_4$, $MgCO_3$, $Al(OH)_3$, synthetic silica, glass beads and diamond. However the diffusing agent is not limited to this.

Figure 31:
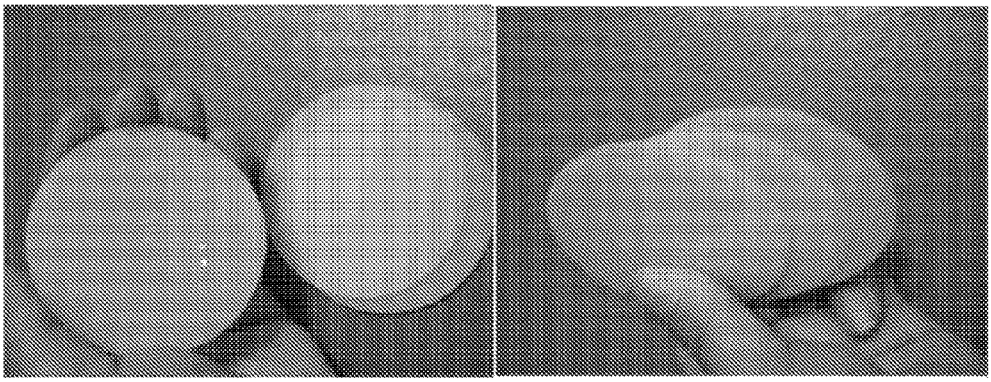
FIG. 31 is a real photograph of the photoluminescent plate according to the manufacturing method shown in FIG. 30.

The polymer substrate made through the manufacturing method shown in FIG. 30 is shown in FIG. 31. Here, the made polymer substrate is heated, and then the photoluminescent plate 530 shown in FIGS. 26 to 29 can be manufactured.

Figure 32:
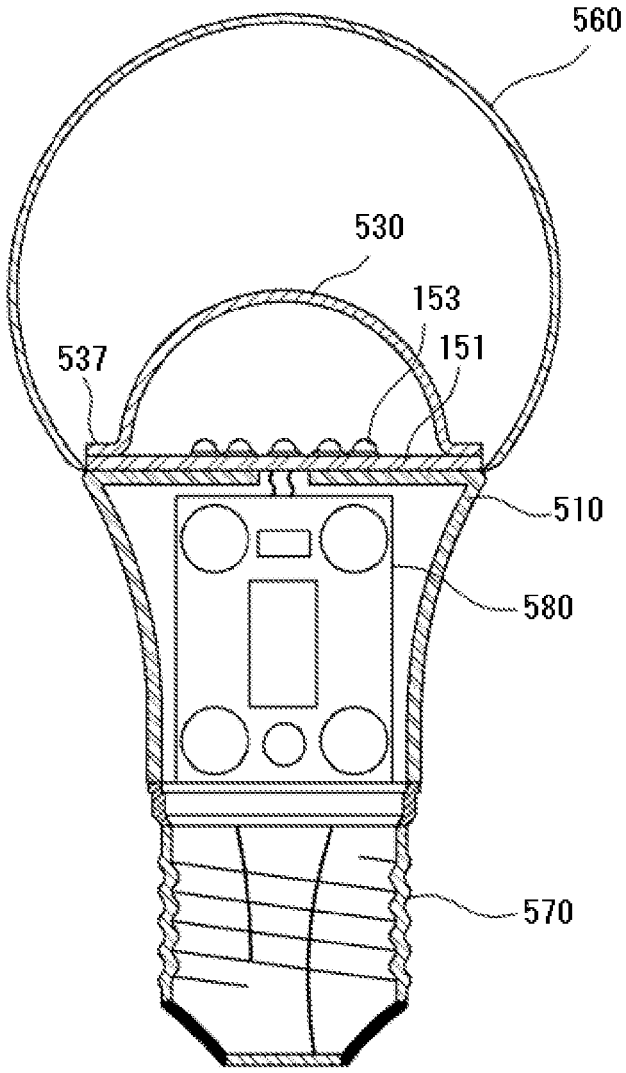
FIG. 32 is a cross sectional view of the lighting device shown in FIG. 27 according to yet another embodiment.

FIG. 32 is a cross sectional view of the lighting device shown in FIG. 27 according to yet another embodiment.

The arrangement structure of the photoluminescent plate 530 of the lighting device according to the embodiment shown in FIG. 32 is different from that of the photoluminescent plate 530 of the lighting device shown in FIG. 27. Since the rest of the configuration of the lighting device shown in FIG. 32 is the same as that of the lighting device shown in FIG. 27, the detailed description thereof will be omitted.

Referring to FIG. 32, outer ends 537 of the photoluminescent plate 530 are disposed on the substrate 151. That is, the outer ends 537 contact with the substrate 151.

If, as shown in FIG. 27, the outer ends of the photoluminescent plate 530 contact with the housing 510, the photoluminescent plate 530 may be modified due to heat from the housing 510 when the light emitting device 153 is operated.

In order to prevent this problem, as shown in FIG. 32, the outer ends 537 of the photoluminescent plate 530 may be disposed on the substrate 151.

The bulb 560 is disposed over the photoluminescent plate 530 and is fastened to the housing 510. The bulb 560 protects the substrate 151, the light emitting device 153 and the photoluminescent plate 530 from the outside.

The inner surface of the bulb 560 may be coated with an opalesque pigment. The pigment may include a diffusing agent such that light passing through the bulb 560 is diffused.

The material of the bulb 560 may be glass. However, the glass is vulnerable to weight or external impact. Therefore, plastic, polypropylene (PP) and polyethylene (PE) and the like can be used as the material of the bulb 560. Here, polycarbonate (PC), etc., having excellent light resistance, excellent thermal resistance and excellent impact strength property can be also used as the material of the bulb 560.

The socket 570 is disposed under the housing 510. The socket 570 is electrically connected to an external power supply. The socket 570 may be integrally formed with the housing 510 or may have a shape which can be coupled to the housing 510.

The power supplier 580 is received in the housing 510. The power supplier 580 converts external electric power and supplies to the light emitting device 153.

The power supplier 580 may include a support plate and a plurality of parts mounted on the support plate. The plurality of the parts may include, for example, a DC converter converting AC power supplied by an external power supply into DC power, a driving chip controlling the driving of the light emitting device 153, and an electrostatic discharge (ESD) protective device for protecting the light emitting device 153, and the like. However, there is no limit to the parts.

Although embodiments of the present invention were described above, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

What is claimed is:

1. A lighting device comprising:

a light source;

a photoluminescent plate comprising:

a first phosphor layer disposed above the light source, the first phosphor layer including a yellow phosphor;

a base layer that transmits light and including one surface having a first roughness and an other surface having a second roughness, the base layer disposed on the first phosphor layer; and a second phosphor layer disposed on the other surface of the base layer, the second phosphor layer including a red phosphor, wherein the photoluminescent plate and the light source are spaced apart from each other by 5 to 10 mm, wherein the base layer is a diffuser substrate or a diffuser plate, wherein the first roughness and the second roughness are different from each other, and wherein the first roughness has a uniform roughness and the second roughness has a non-uniform roughness.

2. The lighting device of claim 1, wherein the base layer further comprises a function of diffusing light.

3. The lighting device of claim 1, wherein the first phosphor layer further comprises at least one of a diffusing agent, an antifoaming agent, and a curing agent.

4. The lighting device of claim 1, wherein the first phosphor layer further comprises at least one of a red, green and blue phosphor.

5. The lighting device of claim 1, wherein the base layer further comprises a diffusing agent.

6. The lighting device of claim 1, further comprising a reflector disposed to surround the light source.

7. The lighting device of claim 6, further comprising a housing which receives the photoluminescent plate, the light source and the reflector and radiates heat from the light source.

8. The lighting device of claim 1, wherein the photoluminescent plate is convex.

9. A lighting device comprising:

a light source comprising:

a substrate;

a light emitting device disposed on the substrate; and a photoluminescent layer disposed on the substrate to be adjacent to the light emitting device and including at least one phosphor; and a photoluminescent plate comprising:

a base layer transmitting light;

a first phosphor layer which is disposed above the light source, the first phosphor layer being on one surface of the base layer and including a yellow phosphor; and a second phosphor layer which is disposed on an other surface of the base layer and including a red phosphor, wherein the base layer is a diffuser substrate or a diffuser plate, and wherein the one surface of the base layer has a uniform first roughness and the other surface of the base layer has a non-uniform second roughness.

10. The lighting device of claim 9, wherein the base layer further comprises a function of diffusing light.

11. The lighting device of claim 9, wherein the photoluminescent plate is convex.

12. A lighting device comprising:

a housing;

a reflector disposed on the inner surface of the housing;

a light source disposed on the reflector; and a photoluminescent plate disposed above the light source and contacting the housing and the reflector, wherein the photoluminescent plate includes:

a base layer, a first phosphor layer and a second phosphor layer, wherein the base layer transmits light and includes one surface having a first roughness and an other surface having a second roughness, wherein the first phosphor layer is disposed on the one surface of the base layer and includes a yellow phosphor, wherein the second phosphor layer is disposed on an other surface of the base layer and includes a red phosphor, wherein the first roughness and the second roughness are different from each other, and wherein the first roughness has a uniform roughness and the second roughness has a non-uniform roughness.

13. The lighting device of claim 12, wherein the base layer further comprises a function of diffusing light.

14. The lighting device of claim 12, wherein the photoluminescent plate is convex.

15. The lighting device of claim 12, wherein the housing comprises:

a bottom surface; and a side surface extending from an end of the bottom surface and having an inclination with respect to the end of the bottom surface.

16. The lighting device of claim 15, wherein the reflector comprises:

a bottom reflector; and a side reflector extending from an end of the bottom reflector and having an inclination with respect to the end of the bottom reflector.

17. The lighting device of claim 16, wherein the photoluminescent plate contacts the side surface of the housing and the side reflector.

18. The lighting device of claim 12, wherein the light source comprises:

a substrate disposed on the reflector;

a light emitting device disposed on the substrate; and a photoluminescent layer disposed on the substrate in such a manner as to be adjacent to the light emitting device and including at least one phosphor.

19. The lighting device of claim 12, wherein the base layer is a diffuser substrate or a diffuser plate.

* * * * *